US011698043B1

(12) United States Patent
Marrack

(10) Patent No.: US 11,698,043 B1
(45) Date of Patent: Jul. 11, 2023

(54) FUEL INJECTOR FOR FUEL SYSTEM HAVING DAMPING ADJUSTMENT VALVE

(71) Applicant: Caterpillar Inc., Peoria, IL (US)

(72) Inventor: Andrew Ogden Marrack, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/690,656

(22) Filed: Mar. 9, 2022

(51) Int. Cl.
*F02M 51/06* (2006.01)
*F02M 21/02* (2006.01)
*F02M 47/06* (2006.01)

(52) U.S. Cl.
CPC .... *F02M 21/0233* (2013.01); *F02M 21/0215* (2013.01); *F02M 21/0242* (2013.01); *F02M 21/0278* (2013.01); *F02M 47/06* (2013.01); *F02M 51/0625* (2013.01)

(58) Field of Classification Search
CPC ..... F02M 21/0278; F02M 21/0242; F02M 21/0215; F02M 21/0233; F02M 47/06; F02M 51/0625
USPC ..... 123/456, 457, 459, 510, 511
See application file for complete search history.

(56) References Cited

U.S. PATENT DOCUMENTS

| | | | |
|---|---|---|---|
| 5,752,659 | A | 5/1998 | Moncelle |
| 5,901,685 | A | 5/1999 | Noyce et al. |
| 7,004,406 | B2 | 2/2006 | Yang et al. |
| 7,066,400 | B2 | 6/2006 | Brenk et al. |
| 7,083,113 | B2 | 8/2006 | Kropp et al. |
| 7,273,185 | B2 | 9/2007 | Magel |
| 7,575,180 | B2 | 8/2009 | Baranowski et al. |
| 9,797,342 | B2 | 10/2017 | Shafer et al. |

FOREIGN PATENT DOCUMENTS

EP 0017872 A1 10/1980

*Primary Examiner* — Hai H Huynh
(74) *Attorney, Agent, or Firm* — Brannon Sowers & Cracraft PC

(57) ABSTRACT

A fuel injector for a fuel system in an internal combustion engine includes an injector housing, a direct-operated nozzle check movable within the injector housing, a check biasing spring within a spring chamber and biasing the nozzle check toward the closed position. The injector housing defines a damping control space, an always-open vent from the spring chamber to the damping control space, and a second vent from the spring chamber to the damping control space. The fuel injector further includes a hydraulically actuated damping adjustment valve movable responsive to a pressure of fuel supplied to the fuel injector between a higher damping position blocking the second vent, and a lower damping position where the second vent is open.

20 Claims, 3 Drawing Sheets

FUEL INJECTOR FOR FUEL SYSTEM HAVING DAMPING ADJUSTMENT VALVE

TECHNICAL FIELD

The present disclosure relates generally to damping a fuel injector, and more particularly to a damping adjustment valve movable between a higher damping position and a lower damping position to selectively vent a spring chamber in a fuel injector.

BACKGROUND

Modern internal combustion engine systems are well-known and widely used throughout the world for diverse purposes ranging from production of electrical power, to vehicle propulsion, powering of pumps, compressors, and industrial equipment. For many applications, notably heavy-duty engine applications, compression-ignition diesel engines are used. In a diesel engine cycle an injection of a compression-ignition fuel is performed at or close to the end of a compression stroke of a piston, with the pressure in the associated cylinder increased to a pressure level sufficient to trigger autoignition of the injected fuel. Autoignition of the fuel causes a rapid pressure and temperature rise in the cylinder, driving the piston to rotate a crankshaft in a well-known manner. As engine load ranges from lower load levels to higher load levels a quantity of fuel injected in each engine cycle needs to be varied. A great many different strategies have been proposed over the years for accurately and precisely injecting desired fuel quantities from a fuel injector.

A fuel system in a compression-ignition engine can be a complex apparatus. Most modern fuel injectors include numerous rapidly moving parts that are electrically or hydraulically actuated, and such injectors are commonly purpose-built for a class of engines or certain engine applications. In recent years the desirability and also challenges of precisely and reliably injecting relatively tiny amounts of fuel, at times, has become evident. Precise control over injection quantity and the ability to inject minute amounts of fuel can be advantageous in many applications respecting emissions and fuel efficiency. At the same time, the capability of injecting large amounts of fuel remains necessary given the sometimes very high power demands placed on such engines. U.S. Pat. No. 5,752,659 to Moncelle is directed to one fuel injection and fuel injector strategy where the injector is configured for controlled closing velocity of a nozzle check in the fuel injector.

SUMMARY

In one aspect a fuel injector for an engine includes an injector housing having formed therein a fuel inlet, a nozzle passage extending to a plurality of nozzle outlets, a check control chamber, and a spring chamber. The fuel injector further includes a direct-operated nozzle check movable between a closed position blocking the plurality of nozzle outlets, and an open position, and a check biasing spring within the spring chamber and biasing the direct-operated nozzle check toward the closed position. The injector housing defines a damping control space fluidly connected to the fuel inlet, an always-open vent from the spring chamber to the damping control space, and a second vent from the spring chamber to the damping control space. The fuel injector further includes a damping adjustment valve movable between a higher damping position blocking the second vent, and a lower damping position where the second vent is open.

In another aspect, a fuel system for an engine includes a variable pressure fuel supply, and a fuel injector having a direct-operated nozzle check, a biasing spring for the direct-operated nozzle check, and a damping adjustment valve. The fuel injector has formed therein a fuel inlet and a damping control space each fluidly connected to the variable pressure fuel supply, a spring chamber receiving the biasing spring, and a plurality of vents connecting between the spring chamber and the damping control space. The damping adjustment valve is hydraulically actuated between a higher damping position where the damping adjustment valve blocks one of the plurality of vents, and a lower damping position where the damping adjustment valve does not block the one of the plurality of vents and at least one of the plurality of vents is open.

In still another aspect, a method of operating a fuel system for an engine includes opening a nozzle check in a fuel injector a first time to spray fuel from the fuel injector, and venting fuel through each of a first vent from a spring chamber in the fuel injector and a second vent from the spring chamber during the opening a nozzle check in a fuel injector a first time. The method further includes varying a pressure of fuel supplied to the fuel injector, and moving a damping adjustment valve from a lower damping position where each of the first vent and the second vent is open, to a higher damping position where the damping adjustment valve blocks the second vent but not the first vent, based on the varying a pressure of fuel. The method further includes opening the nozzle check a second time to spray fuel from the fuel injector, and venting fuel through the first vent but not the second vent during the opening of the nozzle check a second time. The method still further includes damping the opening of the nozzle check a second time based on the venting fuel through the first vent but not the second vent.

DETAILED DESCRIPTION

Figure 1:
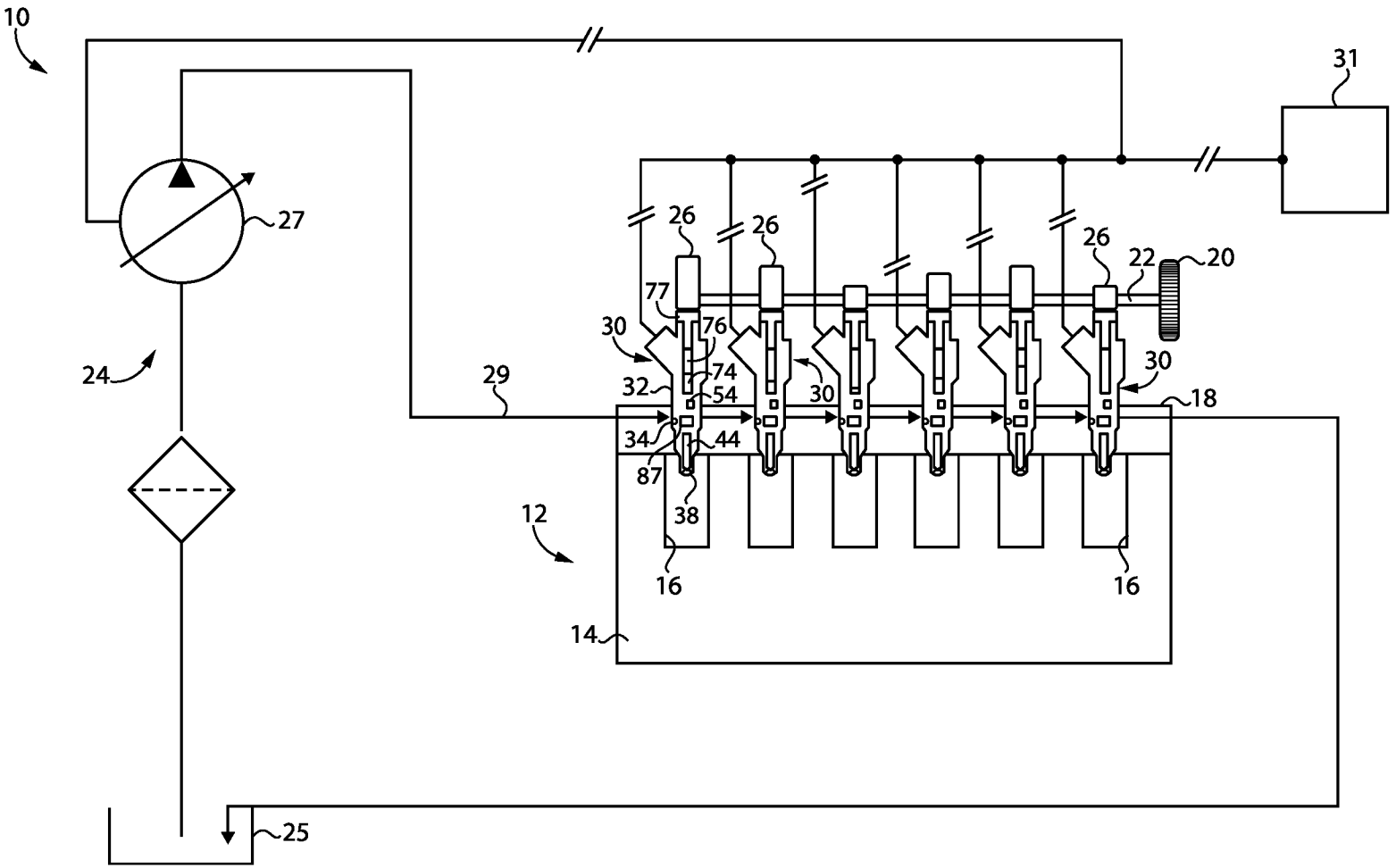
FIG. 1 is a diagrammatic view of an internal combustion engine system, according to one embodiment.

Referring to FIG. 1, there is shown an internal combustion engine system 10, according to one embodiment. Engine system 10 includes an internal combustion engine 12 having an engine housing 14 with a plurality of combustion cylinders 16 formed therein. Combustion cylinders 16 will each be equipped with a piston (not shown) movable therein, typically in a conventional four-stroke pattern, to rotate a crankshaft. Combustion cylinders 16 can include any number and be in any suitable arrangement such as an in-line pattern, a V-pattern, or still another. Engine system 10 can be used for electrical power generation, propelling a vehicle, operating a pump or a compressor, or for a range of other purposes. An engine head 18 is attached to engine housing 14. A cam gear 20 of an engine gear train is rotatable, typically at one-half engine speed, to rotate a camshaft 22 having a plurality of cam lobes 26. Other known and conventional apparatus not specifically illustrated can be part of engine system 10 including an intake system, an exhaust system, and intake valves and exhaust valves supported in engine head 18. In a practical implementation engine system 10 includes a compression-ignition engine system such that pistons in combustion cylinders 16 increase fluid pressures therein to an auto-ignition threshold for injected compression-ignition fuel and air. Engine system 10 also includes a fuel system 24. Fuel system 24 includes a fuel tank 25, a fuel pump 27 structured to convey a fuel, for example a diesel distillate fuel, from fuel tank 25 to engine 12 by way of a fuel conduit 29 to a plurality of fuel injectors 30. Each of fuel injectors 30 may be supported in engine head 18 so as to extend partially into a corresponding one of combustion cylinders 16.

In the illustrated embodiment, fuel pump 27 is adjustable to vary a pressure of fuel supplied by way of fuel conduit 29 to each of fuel injectors 30. Fuel pump 27 could be an electric fuel pump varied in speed to adjust fuel pressure. Fuel pump 27 could also be an inlet metered or an outlet metered pump driven by the engine gear train, for example, and operable to vary fuel pressure. In still other Instances fuel pressure could be varied by way of a valving or pressure bleed arrangement. Fuel pump 27 can thus be understood to be, or be part of, a variable pressure fuel supply. The present disclosure is contemplated as not limited with regard to the particular strategy employed to vary fuel pressure. Engine system 10 also includes an electronic control unit 31, including any suitable programmable logic controller such as a microprocessor or a microcontroller, and a computer readable memory. Electronic control unit 31 is in control communication with each injection control valve assembly 87 to operate fuel injectors 30 and also with fuel pump 27 to vary fuel pressure supplied to fuel conduit 29.

Also in the illustrated embodiment fuel conduit 29 connects to fuel passages formed in engine head 18 to provide a continuous feed of fuel to each of fuel injectors 30, which is pressurized within each individual fuel injector 30 to an injection pressure. To this end, each fuel injector 30 may include an injector housing 32 having formed therein a plunger cavity 74, and further including a fuel pressurization plunger 76 having a tappet 77 that is in contact with one of cam lobes 26. Each tappet 77 reciprocates, with the assistance of a return spring, between an advanced position and a retracted position to pressurize fuel in the corresponding plunger cavity 74. In other embodiments fuel injectors 30 could be hydraulically actuated to pressurize fuel therein, or a common pressurized fuel reservoir or common rail could be used. Each fuel injector 30 also includes an injection control valve assembly 87 operably coupled to a direct-operated nozzle check 44. Each fuel injector 30 is further provided with a damping valve assembly 54, the operation and significance of which is further discussed herein.

Figure 2:
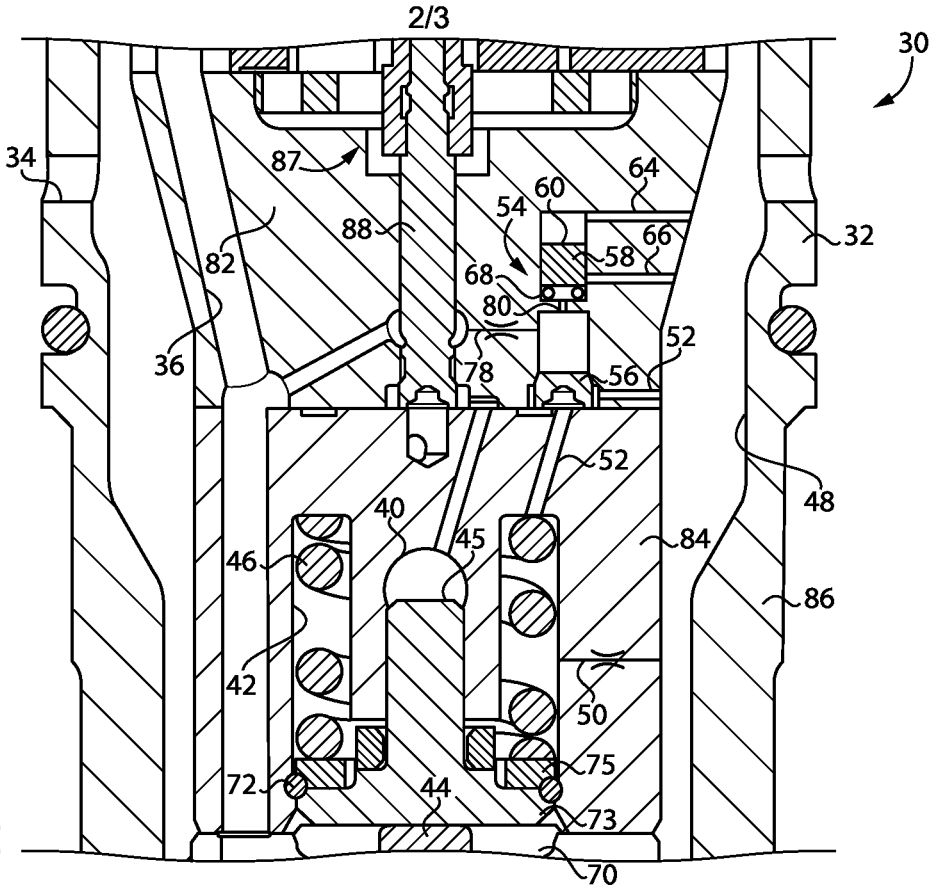
FIG. 2 is a sectioned side diagrammatic view of a portion of a fuel injector having a damping adjustment valve in a higher damping position, according to one embodiment.

Referring also now to FIG. 2, each fuel injector 30, hereinafter referred to at times in the singular, includes an injector housing 32 as noted above. Injector housing 32 has formed therein a fuel inlet 34, a nozzle passage 36 extending to a plurality of nozzle outlets 38, a check control chamber 40, and a spring chamber 42. A direct-operated nozzle check 44 as mentioned above is movable within injector housing 32 between a closed position blocking the plurality of nozzle outlets 38, and an open position. Nozzle check 44 includes a closing hydraulic surface 45 exposed to a fluid pressure of check control chamber 40. Operation of injection control valve assembly 87 varies a pressure of fuel in check control chamber 40 acting upon closing hydraulic surface 45 in a generally known manner to cause opening and closing of nozzle check 44 to control timing and duration of fuel injection. Fuel injector 30 further includes a check biasing spring 46 within spring chamber 42 and biasing nozzle check 44 toward the closed position. Fuel injector 30 and injector housing 32, hereinafter referred to at times interchangeably, defines a damping control space 48 fluidly connected to fuel inlet 34. In the illustrated embodiment damping control space 48 is formed in injector housing 32.

Injector housing 32 further has formed therein a plurality of vents, defining an always-open vent 50 extending from spring chamber 42 to damping control space 48, and a second vent 52 extending from spring chamber 42 to damping control space 48. Fuel injector 30 also includes damping valve assembly 54 as noted above, having a damping adjustment valve 56 movable between a higher damping position blocking second vent 52, and a lower damping position where second vent 52 is open. At the higher damping position one of the plurality of vents is blocks and at least one other vent remains open in a typical configuration. At the lower damping position the one of the plurality of vents is open, in a typical configuration. The terms "higher" and "lower" are used herein in relation to one another. A higher damping position means that greater damping is applied to motion of nozzle check 44, whereas a lower damping position means that less damping, including potentially zero damping, is applied to motion of nozzle check 44. In an implementation, a flow area of always-open vent 50 is less than a flow area of second vent 52.

Damping adjustment valve 56 may be movable between the respective higher damping position and lower damping position responsive to a supply pressure of fuel conveyed to fuel injector 30. Accordingly, where more damping is desired a higher fuel pressure or a lower fuel pressure, depending upon design of damping valve assembly 54, can be applied, whereas when less damping or no damping is desired a varied fuel pressure, again higher or lower depending upon design of damping valve assembly 54, may be provided. In the illustrated embodiment damping valve 56 includes a poppet valve. In other embodiments a slide-type valve such as a spool valve, or a plurality of separate poppet valves or a combination of one or more poppet valves and one or more spool valves might be used.

In one implementation damping valve assembly 54 may include a hydraulically actuated control piston 58 unconnected to damping adjustment valve 54. Control piston 58 includes a first hydraulic control surface 60 exposed to a fuel pressure of damping control space 48, and a second hydraulic control surface 61 opposite to first hydraulic control surface 60 and also exposed to a fuel pressure of damping control space 48. A surface area of first hydraulic control surface 60 exposed to a fuel pressure of damping control space 48 may be larger than a surface area of second hydraulic control surface 61 exposed to a fuel pressure of damping control space 48. A valve control volume 62 may be formed between control piston 58 and damping adjustment valve 56. Also in the illustrated embodiment an orifice 80 restricting flow fluidly connects between valve control volume 62 and control piston 58. Injector housing 32 may further have formed therein a first piston control passage 64 communicating a fuel pressure of damping control space 48 to first hydraulic control surface 60, and a second piston control passage 66 communicating a fuel pressure of damping control space 48 to second hydraulic control surface 61.

Control piston 58 is movable between a first piston position where second piston control passage 66 is open and a second piston position where control piston 58 blocks second piston control passage 66. A biasing spring 68 may be provided biasing control piston 58 toward the first piston position. FIG. 2 also illustrates another orifice 78 fluidly connecting control volume 62 to nozzle supply passage 36.

Fuel injector 30 may further include a first stack piece 82 and a second stack piece 84 clamped in contact within a nozzle case 86. A check control valve 88 of injection control valve assembly 87 is movable within first stack piece 82 to open and close a seat (not numbered). Spring chamber 42 and always-open vent 50 may be formed in second stack piece 84, and second vent 52 may be formed in part within first stack piece 82 and second stack piece 84, and such that damping adjustment valve 54 opens and closes a valve seat (not numbered) formed in second stack piece 84 to open and close fluid connection between the parts of second vent 54 in the respective first stack piece 82 and second stack piece 84. First piston control passage 64 and second piston control passage 66 may each be formed in first stack piece 82. Other arrangements of first piston control passage 64, second piston control passage 66, as well as always-open vent 50 and second vent 52, relative to first stack piece 82 and second stack piece 84, are within the scope of the present disclosure.

Injector housing 32 further has formed therein a nozzle chamber 70, and fuel injector 30 further includes a seal 72 between nozzle chamber 70 and spring chamber 42. Seal 72 may include a sealing element, such as a non-metallic sealing element in the nature of an O-ring, supported between a head 73 of nozzle check 44 and a button 75. Seal 72 may thus be sandwiched between button 75 and head 73 and fluidly separates spring chamber 42 from nozzle chamber 70. While seal 72 is attached to nozzle check 44 in the illustrated embodiment, in other instances a tight clearance fit or potentially still another sealing strategy could be used.

In FIG. 2 damping valve assembly 54 is shown as it might appear where a higher fuel pressure is supplied by way of fuel pump 27 to damping control space 48. The higher fuel pressure has acted upon first hydraulic control surface 60 to urge control piston 58 toward the second piston position blocking second piston control passage 66, overcoming a biasing force of biasing spring 68. In this configuration control piston 58 has displaced hydraulic fluid into control volume 62 and urged damping adjustment valve 56 downward to block second vent 52. Always-open vent 50 remains open. When nozzle check 44 is actuated open a flow of fuel out of spring chamber 42 will be restricted to always-open vent 50 causing nozzle check 44 during opening and typically also during closing to be relatively highly damped.

Figure 3:
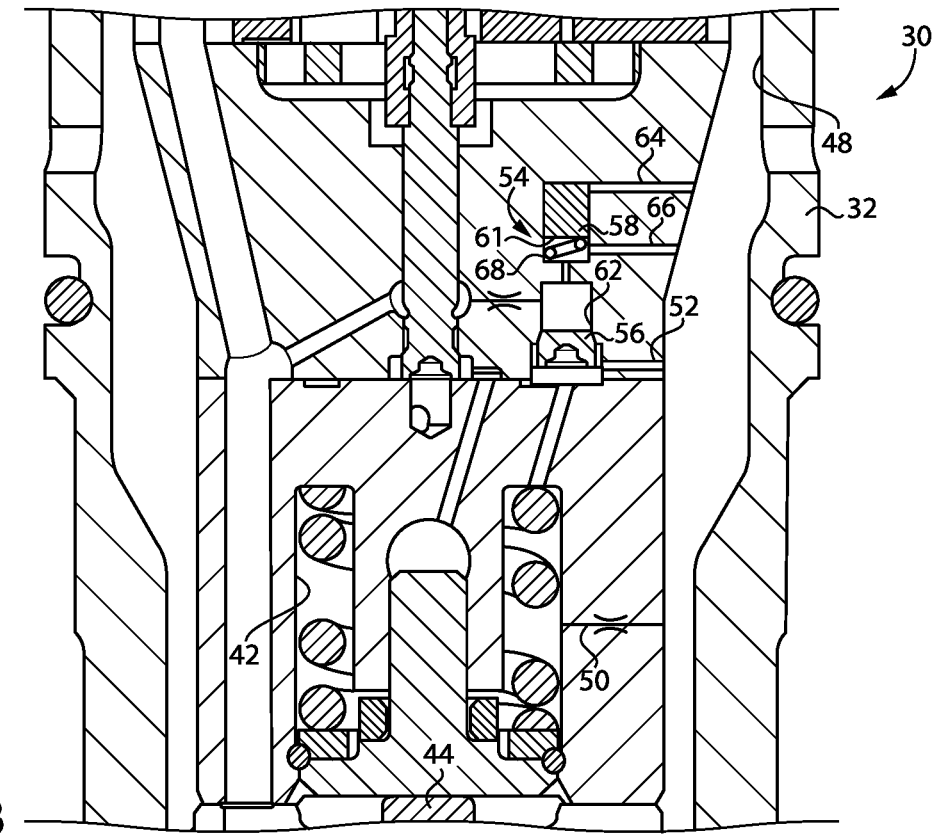
FIG. 3 is a sectioned side diagrammatic view as in FIG. 2 showing the damping adjustment valve in a lower damping position.

Referring now to FIG. 3 there is shown damping valve assembly 54 as it might appear when a lower pressure of fuel is supplied to damping control space 48 by fuel pump 27. In this state control piston 58 has been urged toward the first control piston position by way of biasing spring 68 such that damping adjustment valve 56 has moved toward its lower damping position to open second vent 52. Accordingly, when nozzle check 44 is actuated open fuel expelled from spring chamber 42 can travel through each of always-open vent 50 and second vent 52 to damping control space 48, causing nozzle check 44 to be less damped, if at all. It can therefore be seen that by varying fuel pressure supplied to fuel injector 30 damping adjustment valve 56 can be moved between the higher damping position as depicted in FIG. 2 and the lower damping position as depicted in FIG. 3. It will also be appreciated that the described increased fuel pressure to position damping adjustment valve 56 at the higher damping position and lower fuel pressure to position damping adjustment valve 56 at the lower damping position could be reversed. In other words, while in the illustrated embodiment a higher fuel pressure moves control piston 58 to bias damping adjustment valve 56 to close vent 52 alternative arrangements could utilize a higher fuel pressure to cause damping adjustment valve 56 to open second vent 52. In still other instances a spool valve or a different valve arrangement altogether could be used.

INDUSTRIAL APPLICABILITY

Figure 4:
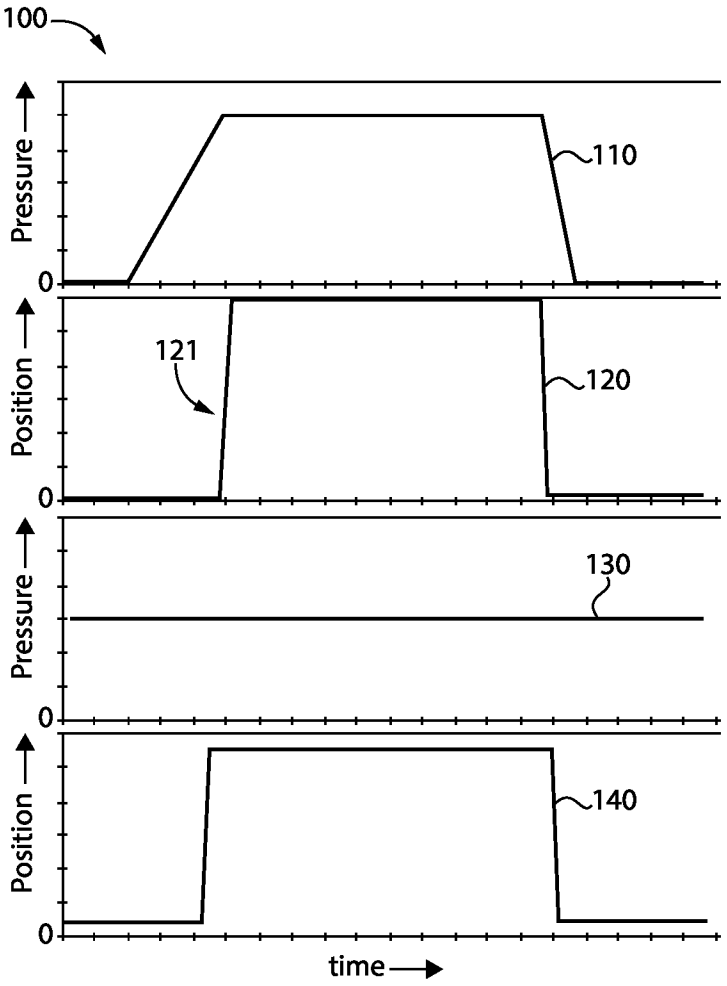
FIG. 4 is a graph of fuel injection properties with a damping adjustment valve in a lower damping position.

Referring also now to FIG. 4, there is shown a graph 100 illustrating fuel injection states or properties when lower damping is applied, such as by positioning damping adjustment valve 56 at the position shown in FIG. 3. An injection pressure trace is shown at 110. A fuel supply pressure is shown at 130, nozzle check position is shown at 120, and damping adjustment valve position is shown at 140. It can be seen that at the fuel pressure that is supplied damping adjustment valve 140 moves to open second vent 50 as nozzle check 44 is actuated open. An initial portion 121 of check position trace 120 shows a relatively rapid opening of nozzle check 44. A relatively rapid closing of nozzle 44 will typically also be observed.

Figure 5:
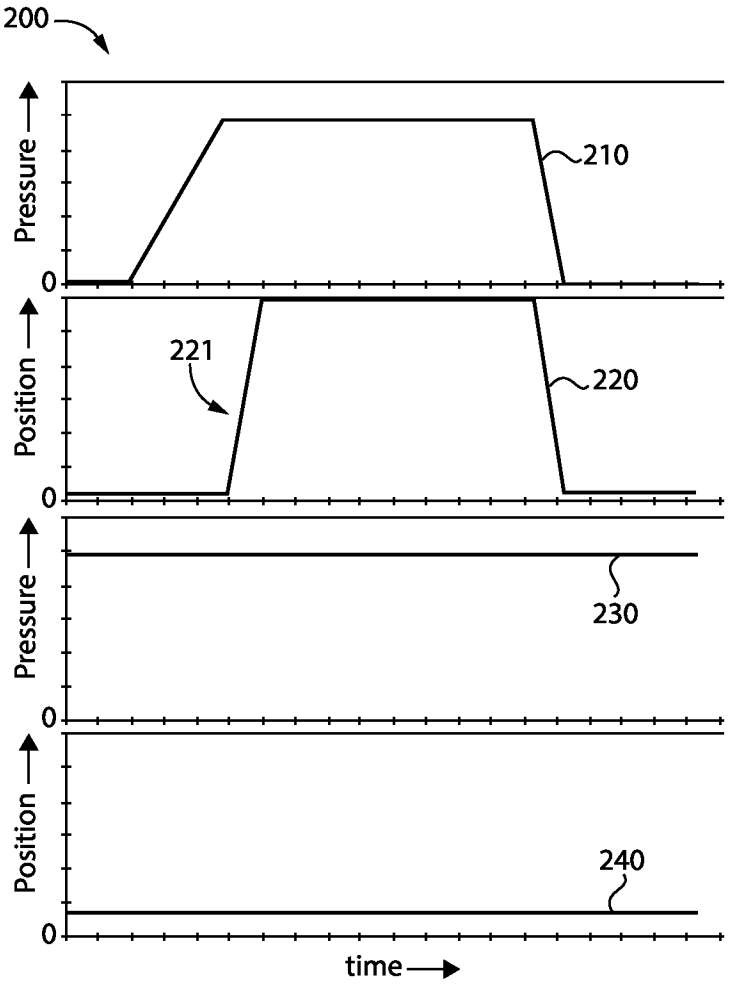
FIG. 5 is a graph of fuel injection properties with a damping adjustment valve in a higher damping position.

Referring also to FIG. 5, there is shown another graph 200 illustrating fuel injection states or properties when higher damping is applied, such as by positioning damping adjustment valve 56 at the position shown in FIG. 2. In FIG. 5, injection pressure is shown at 210, fuel supply pressure is shown at 230, check position is shown at 220, and damping adjustment valve position is shown at 240. It can be seen that the fuel supply pressure 230 is relatively greater than in the case of the FIG. 4 example, and that damping adjustment valve 56 remains seated blocking second vent 52. It can also be seen from FIG. 5 that a change in check position 220 is relatively less rapid in an initial portion 221, as well as in an ending portion. In general the differences between trace 120 in FIG. 4 and trace 220 in FIG. 5 illustrate the damping that might be observed on check opening and closing at the different damping adjustment valve states.

It will be recalled that it can be desirable in some instances for a fuel injector to inject relatively tiny shots of liquid fuel such as when operating at a low engine load, whereas in other instances it can be desirable to inject relatively greater amounts of fuel such as when operating at a rated engine load. Many known fuel injectors are designed either for optimal operation at rated load or optimal operation at very low loads, with a difference in performance between operation for large injections versus operation for tiny injections being known as a "turn-down" effect. Put differently, in some instances fuel injectors can be difficult to reliably and repeatably control to inject tiny amounts of fuel, difficult to reliably and repeatably control to inject greater amounts of fuel, or exhibit other performance penalties. According to the present disclosure, damping of a nozzle check can be applied selectively to better control injection of tiny amounts of fuel, including one or more small shots of fuel in an engine cycle.

Operating fuel system 24 can include opening nozzle check 44 in fuel injector 30 a first time to spray fuel from fuel injector 30 in a first engine cycle, and venting fuel through each of a first vent, such as always-open vent 50, from spring chamber 42, and a second vent, such as second vent 52, from spring chamber 42, during opening nozzle check 44 a first time. Opening nozzle check 44 a first time could include opening nozzle check 44 to inject a relatively greater amount of fuel or a relatively smaller amount of fuel.

When it is desirable to adjust damping of nozzle check 44 a pressure of fuel supplied to fuel injector 30 may be varied. As a result, damping adjustment valve 54 may be moved from a lower damping position where each of the first vent and the second vent is open to a higher damping position where damping adjustment valve 54 blocks the second vent but not the first vent, based on the varying a pressure of fuel. With damping adjustment valve 54 adjusted or now capable of being adjusted in response to nozzle check opening, nozzle check 44 may be opened a second time to spray fuel from fuel injector 30, and fuel vented through the first vent but not the second vent during the opening nozzle check 44 a second time. With the first vent open to vent fuel but the second vent not opened to vent fuel, opening of nozzle check 44 the second time as well as the following closing of nozzle check 44 may be damped. It will be recalled that an increased pressure of supplied fuel could be used to obtain greater damping, however, depending upon system design a decreased pressure of fuel supplied could be used to obtain greater damping.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel injector for an engine comprising:

an injector housing having formed therein a fuel inlet, a nozzle passage extending to a plurality of nozzle outlets, a check control chamber, and a spring chamber;

a direct-operated nozzle check movable between a closed position blocking the plurality of nozzle outlets, and an open position;

a check biasing spring within the spring chamber and biasing the direct-operated nozzle check toward the closed position;

the injector housing defining a damping control space fluidly connected to the fuel inlet, an always-open vent from the spring chamber to the damping control space, and a second vent from the spring chamber to the damping control space; and a damping adjustment valve movable between a higher damping position blocking the second vent, and a lower damping position where the second vent is open.

2. The fuel injector of claim 1 wherein the damping control space is formed in the injector housing.

3. The fuel injector of claim 2 wherein a flow area of the always-open vent is less than a flow area of the second vent.

4. The fuel injector of claim 1 further comprising a hydraulically actuated control piston operably coupled to the damping adjustment valve and having a hydraulic control surface exposed to a fuel pressure of the damping control space, and a valve control volume formed between the control piston and the damping adjustment valve.

5. The fuel injector of claim 4 wherein:

the injector housing further having formed therein a first piston control passage communicating a fuel pressure of the damping control space to the hydraulic control surface, and a second piston control passage fluidly connecting the valve control volume to the damping control space; and the control piston is movable between a first piston position where the second piston control passage is open and a second piston position where the control piston blocks the second piston control passage.

6. The fuel injector of claim 5 further comprising a biasing spring biasing the control piston toward the first piston position.

7. The fuel injector of claim 1 wherein the injector housing further having formed therein a nozzle chamber, and further comprising a seal between the nozzle chamber and the spring chamber.

8. The fuel injector of claim 7 wherein the seal includes a sealing element attached to the nozzle check.

9. The fuel injector of claim 1 wherein the injector housing further having formed therein a plunger cavity, and further comprising a fuel plunger including a tappet and movable within the plunger cavity.

10. A fuel system for an engine comprising:

a variable pressure fuel supply;

a fuel injector including a direct-operated nozzle check, a biasing spring for the direct-operated nozzle check, and a damping adjustment valve;

the fuel injector having formed therein a fuel inlet and a damping control space each fluidly connected to the variable pressure fuel supply, a spring chamber receiving the biasing spring, and a plurality of vents connecting between the spring chamber and the damping control space; and the damping adjustment valve being hydraulically-actuated between a higher damping position where the damping adjustment valve blocks one of the plurality of vents, and a lower damping position where the damping adjustment valve does not block the one of the plurality of vents and at least one of the plurality of vents is open.

11. The fuel system of claim 10 wherein the damping adjustment valve includes a poppet valve.

12. The fuel system of claim 10 wherein the fuel injector further having formed therein a nozzle supply passage, a valve control volume defined in part by the damping adjustment valve, and an orifice fluidly connecting the valve control volume to the nozzle supply passage.

13. The fuel system of claim 10 wherein the plurality of vents includes an always-open vent.

14. The fuel system of claim 13 wherein a flow area of the always-open vent is less than a flow area of the one of the vents.

15. The fuel system of claim 13 wherein:

the fuel injector further includes a first stack piece and a second stack piece clamped in contact within a nozzle case, and a check control valve movable within the first stack piece; and the spring chamber and the always-open vent are formed in the second stack piece, and the one of the plurality of vents is formed in part within the second stack piece and in part within the first stack piece.

16. The fuel system of claim 10 wherein the fuel injector further having formed therein a nozzle chamber, and further comprising a seal between the nozzle chamber and the spring chamber.

17. A method of operating a fuel system for an engine comprising:

opening a nozzle check in a fuel injector a first time to spray fuel from the fuel injector;

venting fuel through each of a first vent from a spring chamber in the fuel injector and a second vent from the spring chamber during the opening a nozzle check in a fuel injector a first time;

varying a pressure of fuel supplied to the fuel injector;

moving a damping adjustment valve from a lower damping position where each of the first vent and the second vent is open, to a higher damping position where the damping adjustment valve blocks the second vent but not the first vent, based on the varying a pressure of fuel;

opening the nozzle check a second time to spray fuel from the fuel injector;

venting fuel through the first vent but not the second vent during the opening the nozzle check a second time; and damping the opening of the nozzle check a second time based on the venting fuel through the first vent but not the second vent.

18. The method of claim 17 wherein the opening a nozzle check a first time includes spraying a greater amount of fuel, and the opening the nozzle check a second time includes spraying a lesser amount of fuel.

19. The method of claim 17 further comprising hydraulically actuating the damping adjustment valve from the lower damping position to the higher damping position.

20. The method of claim 19 wherein the hydraulically actuating the damping adjustment valve includes hydraulically actuating the damping adjustment valve by way of an unconnected control piston.

* * * * *